US005351862A

United States Patent [19]

Weag

[11] Patent Number: 5,351,862

[45] Date of Patent: Oct. 4, 1994

[54] DISPENSING PUMP FOR MEDIA OF LOW VISCOSITY, ESPECIALLY PASTE-LIKE MEDIA

[75] Inventor: Ernst Weag, Villingen-Schwenningen, Fed. Rep. of Germany

[73] Assignee: Raimund Andris GmbH & Co. KG

[21] Appl. No.: 46,648

[22] Filed: Apr. 13, 1993

[30] Foreign Application Priority Data

Apr. 14, 1992 [DE] Fed. Rep. of Germany ..... 4212413

[51] Int. Cl.[5] ..... B67D 5/60

[52] U.S. Cl. ..... 222/145; 222/209; 222/327

[58] Field of Search ..... 222/105, 135, 145, 209, 222/255, 326, 327, 385

[56] References Cited

U.S. PATENT DOCUMENTS

| | | | |
|---|---|---|---|
| 4,438,871 | 3/1984 | Eckert | 222/137 |
| 4,846,372 | 7/1989 | von Schuckmann | 222/145 X |
| 4,979,646 | 12/1990 | Andris | 222/145 X |
| 5,042,694 | 8/1991 | Birmelin | 222/209 X |
| 5,224,627 | 7/1993 | Weag | 222/135 |
| 5,238,156 | 8/1993 | Andris | 222/209 X |

FOREIGN PATENT DOCUMENTS

| | | | |
|---|---|---|---|
| 0194417 | 1/1986 | European Pat. Off. . | |
| 0245172 | 11/1987 | European Pat. Off. | 222/145 |
| 8800880.0 | 7/1989 | Fed. Rep. of Germany . | |
| 3817632 | 11/1989 | Fed. Rep. of Germany | 222/209 |

*Primary Examiner*—Andres Kashnikow
*Assistant Examiner*—Joseph A. Kaufman
*Attorney, Agent, or Firm*—McGlew and Tuttle

[57] ABSTRACT

A dispensing pump (1) made of plastic for dispensing metered amounts of paste-like media includes a bottle-, can- or tube-like container (60), with an elastic bellows (4) acting as a pumping member, which is connectingly arranged between an upper housing part (2) and a telescopingly movable, lower housing part (3), which is coaxial thereto, and whose interior (32) forms a pump chamber. Its upper end section (38) is connected to an annular wall (35) of the upper housing part (2). Its lower end section (45) is in sealing contact with an annular shoulder (46) of a radial partition (19) of the lower housing part (3). A second pump chamber (33, 33/1 ) for a second medium, which communicates with the discharge opening (10) of the upper housing part through a second discharge valve and/or at least one flow opening (34) in the partition (13), is formed by two annular wall sockets (30, 31 ), which are telescopingly guided one inside the other, concentrically surround the bellows (4) at a radially spaced location, and are made in one piece with one of the two housing parts (2, 3) each. On the suction side, the second pump chamber is connected to an annular chamber (81) of a container (61) or to a second container via at least one eccentric suction channel (82) in the radial wall (19).

16 Claims, 7 Drawing Sheets

DISPENSING PUMP FOR MEDIA OF LOW VISCOSITY, ESPECIALLY PASTE-LIKE MEDIA

FIELD OF THE INVENTION

The present invention pertains to a dispensing pump made of plastic for dispensing metered amounts of media of low viscosity, especially paste-like media from a bottle-, can-, or tube-like container, with an elastic bellows acting as a pumping member, which is connectingly arranged between a dimensionally stable, upper housing part and a lower, likewise dimensionally stable housing part, which is coaxial thereto and is telescopingly movable, and whose interior forms a pump chamber, through which the medium is pumped, wherein its upper end section is in sealing contact with an annular wall of a radial intermediate wall of the upper housing part, which intermediate wall is provided with at least one paste flow opening and/or one discharge valve, and its lower end section is in sealing contact with an annular shoulder of a radial partition of the lower housing part, and wherein the lower housing part has a discharge opening, and the lower housing part is provided with a suction valve, which connects the container to the pump chamber, as well as with a suction tube socket, by which the suction valve is or can be connected to the container.

BACKGROUND OF THE INVENTION

A dispensing pump of this type has been known from, e.g., West German Utility Model No. DE-Gbm 88,00,880.0. The partition of the upper housing part, which is telescopingly guided in the lower housing part, is provided there with a pipe socket, which is directed in the downward direction toward the partition and the suction valve, and is surrounded by a reinforced annular shoulder of the bellows. This pipe socket is provided on its top side with a conical valve seat annular surface, on which a closing member is elastically seated, and the said closing member is elastically supported at the closing front wall of the upper, two-part housing part, and is movably guided in the pipe socket by means of an axial cross rib. The upper housing part consists of two hollow bodies, which are lockingly connected to one another, and one of which has a cylindrical guide wall, with which it is axially movably guided in the lower housing part between two end positions. The second hollow body of the upper housing part, which is lockingly inserted into a projecting cylindrical wall section above the partition, has an eccentric, channel-like discharge opening, which extends axially parallel and is in direct connection with a hollow space, in which the closing member of the discharge valve is arranged, and which is also connected, via this discharge valve, to the interior of the bellows, while the upper housing part as a whole moves in relation to the lower housing part, performing a delivery stroke in the downward direction.

Even though it is possible, in principle, in this type of dispensing pump (to which also corresponds, e.g., the dispensing pump according to EP-A-0,194,417, and which have a bellows as a pumping member), to draw in two or more different media simultaneously from separate containers, the mixing of these media is uncontrollable, because all the media drawn in simultaneously flow through the same pump chamber.

A paste dispenser has also been known (U.S. Pat. No. 4,438,781), but it has no bellows as the pumping member, but two pump plungers, which can be actuated manually and draw two media simultaneously, in cooperation with suction valves, from two paste containers, which are located concentrically one in the other, but are separated from each other, and are provided with a follower plunger each, and deliver them via separate channels into a storage space, which is arranged directly in front of a discharge opening. This storage space surrounds a plunger-like closing member, which is arranged at an elastic diaphragm wall, to which the delivery pressure of the medium is admitted.

The two pump plungers are arranged coaxially to one another, are rigidly connected to one another, and are provided with a common actuating member, which is actuated manually. To pump different amounts, the pump plungers have different diameters. The likewise coaxial, cylindrical pump chambers, which communicate with the separate paste containers via suction valves, are connected via separate discharge valves to two separate guide channels, which, extending approximately axially parallel, are arranged eccentrically to the pump chambers, and open into the storage space.

This leads to a labyrinth-like shape of the space of the pump chambers connected to each other and of the guide channels, which is difficult and expensive to prepare, so that it is unsuitable for mass production, especially in the case of a so-called disposable article.

SUMMARY AND OBJECTS OF THE INVENTION

The basic object of the present invention is to provide a dispensing pump of the type described above—while maintaining the simplicity of manufacture, which arises especially from the use of a bellows as a pumping member—with a second pump chamber, by which a second medium can be delivered, simultaneously with a first medium and separate therefrom, from a separated container space of the same container or from a second, separate container, to a common or separate discharge opening.

This object is attained by a second pump chamber for a second medium being formed by two annular wall sockets, which concentrically surround the bellows at a radially spaced location therefrom and are each made in one piece with one of the two housing parts, wherein the second pump chamber communicates through a second discharge valve and/or at least one flow opening in the partition with the discharge opening, and which is connected on the suction side, via at least one eccentric suction channel in the partition of the lower housing part, to an annular space of the container, which annular space surrounds the suction socket, or to a second container.

In the dispensing pump according to the present invention, the bellows acts as a single pumping member simultaneously in two separate pump chambers, by which metered amounts of two media can be pumped separately at different quantity ratios and delivered to separate discharge openings. It is possible to influence or change the quantity ratio of the two media by varying the volumes of the pump chambers as well as the cross section ratios of the suction openings, on the one hand, and the discharge-side flow cross sections, on the other hand.

Another advantage of the dispensing pumps according to the present invention is mainly the fact that no additional individual parts are needed for forming the second pump chamber, but the means used is formed of shaped elements, which are made in one piece with components already present, and another important advantage can be considered to be the fact that assembly is not rendered more expensive by the added shaped elements.

While the advantageous embodiments of the invention relating to flow openings and partitions and other structural components, contribute to achieving a simple, easy-to-mount and functionally reliable shaping, the embodiments of the invention including annular channels connected to a discharge channel and other similar structure, make it possible, in an advantageously simple manner, to the dispensing pump for the simultaneous removal of two media, e.g., at a ratio of 1:1 or at a different quantity ratio, from two separate containers, to which the dispensing pump can be connected in a likewise simple manner. However, it is also possible to pump only one medium from one container with the dispensing pump according to the present invention, in which case it is completely irrelevant that one of the two pump chambers remains inoperative.

A further embodiment is proposed including a variant with discharge opening and discharge channel wherein the upper housing part is subdivided by a partition into two compartments, providing advantageous design possibilities for the discharge channel and the discharge opening, respectively.

It is a further object of the invention to provide a paste dispenser which can dispense paste from two different sources and which dispenser is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
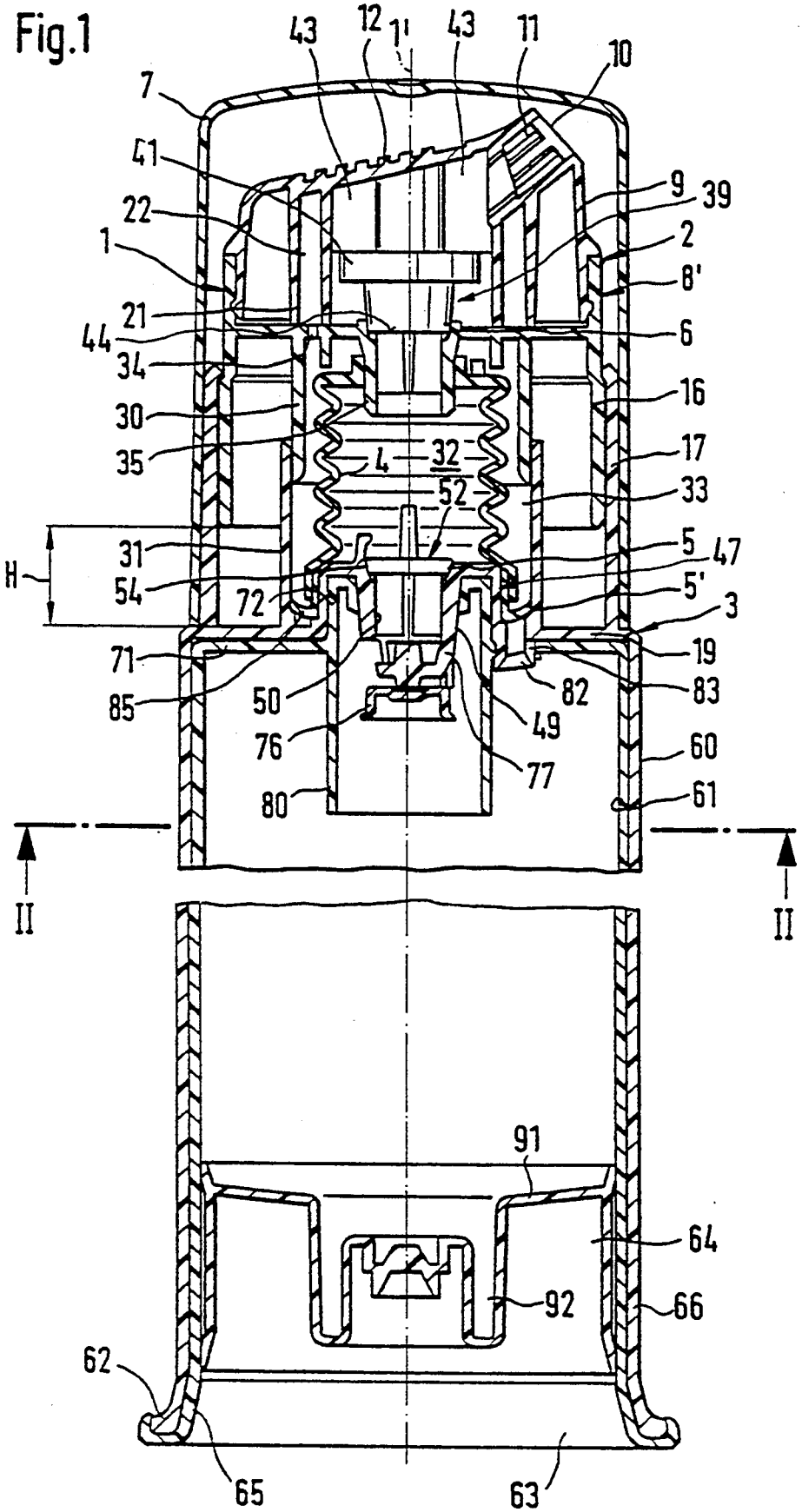
FIG. 1 is a sectional view of a complete paste dispenser with a dispensing pump.
Figure 1A:
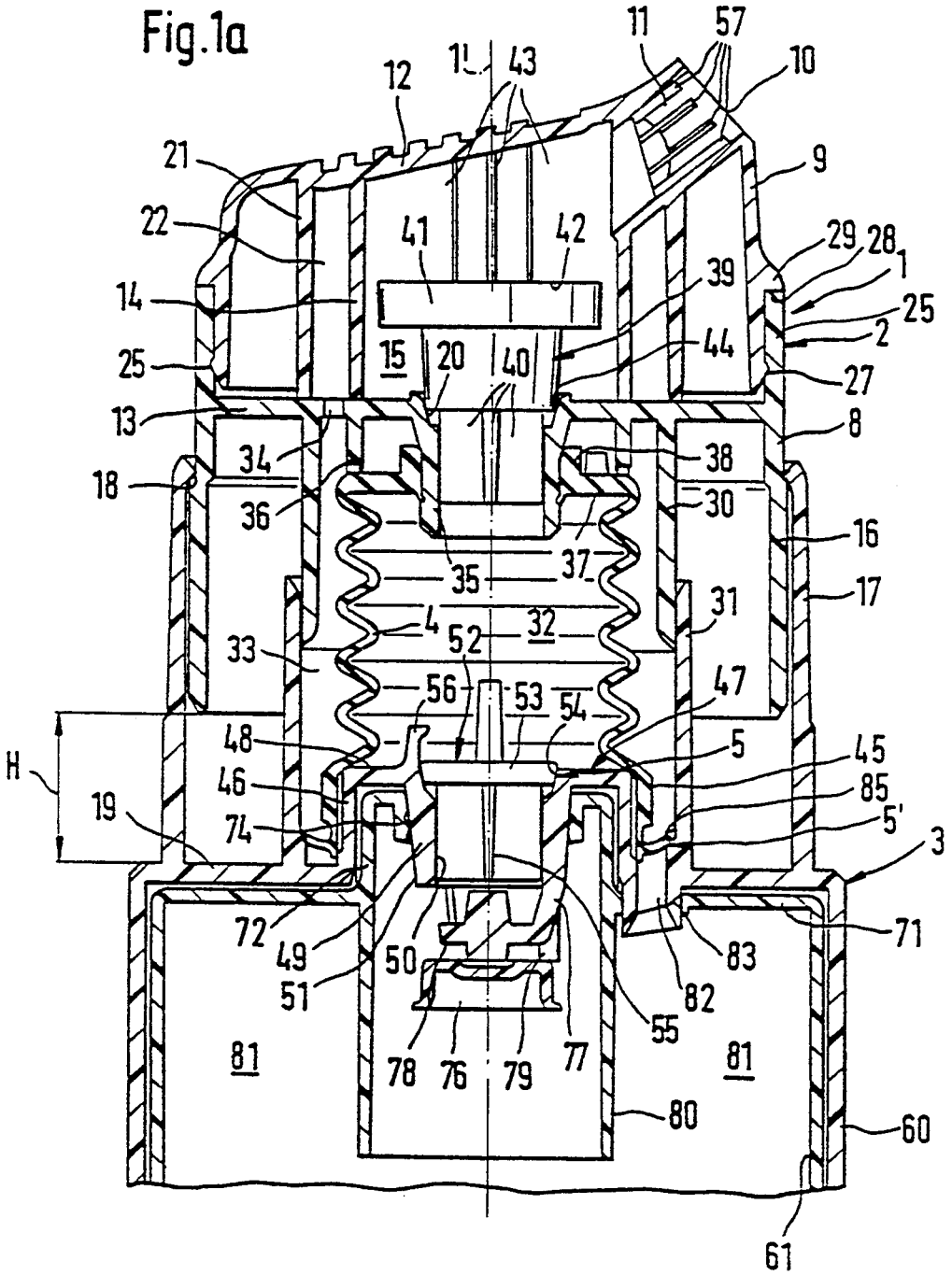
FIG. 1*a* is a sectional view of the dispensing pump according to FIG. 1 on an enlarged scale.
Figure 2:
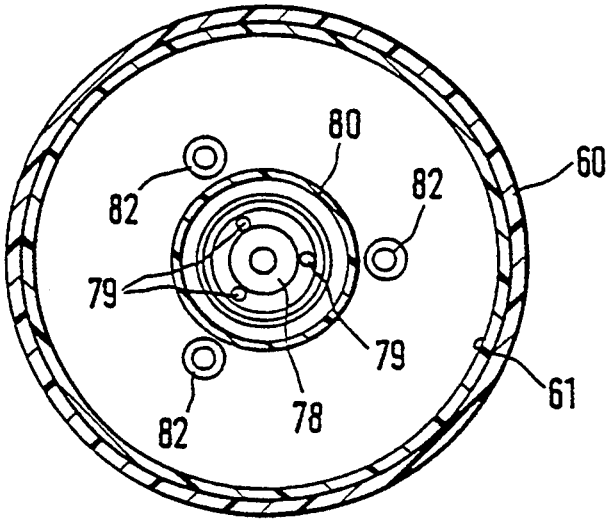
FIG. 2 is a sectional view taken along line II—II from FIG. 1.

The paste dispenser shown in FIGS. 1 and 1*a* has as the head part an integrated dispensing pump 1. This dispensing pump is essentially comprised of two cylindrical housing parts 2 and 3, a bellows 4, a suction valve 5, and a discharge valve 6. While the two housing parts 2 and 3 consist of a hard, dimensionally stable plastic, the bellows 4 consists of a softer, elastic plastic, which is also able to generate the restoring forces that are necessary for the pumping process for the housing part 2 in relation to the housing part 3. The dispensing pump 1 is provided with an easy-to-remove protective cap 7, which is to be removed for use.

The housing part 2 consists of a cylindrical housing lower part 8 and a housing upper part 9, which is connected thereto in a positive-locking and non-positive manner and has a discharge opening 10, which forms the outer end of a discharge channel 11. The housing upper part 9 is provided with an oblique cover wall 12, which is ribbed on its top side, and with which an essentially cylindrical chamber wall 14, which is seated on a partition 13 of the housing upper part 8, is made in one piece. The chamber wall 14 surrounds a discharge chamber 15, which communicates with the discharge channel 11, and is in turn surrounded by a likewise cylindrical annular channel wall 21, which surrounds an annular channel 22, which communicates with the discharge channel 11 via two lateral openings 23 and 24. The annular channel wall 21 is also sealingly seated on the partition 13. As is apparent from FIG. 7, the discharge channel 11 and the discharge opening 10 have the cross-sectional shape of an elongated hole, which is horizontal in the vertical position of the axis of symmetry 1', and is defined by two semicircles 10/1, 10/2 and by two parallel walls 11/1, 11/2 connecting same. The inner sides of the semicircles 10/1, 10/2 are provided with axially parallel guide ribs 57 each, which form striping channels 58, through which the second medium is added in a the form of a strip to the strand of the first medium being dispensed.

With a lower, cylindrical guide section 16, the housing lower part 8 extends into a guide cylinder 17 of the housing part 3, so that it is movable by an axial stroke H between an inner annular rib 18 of the guide cylinder 17 and a radial wall 19 of the housing part 3.

Figure 5:
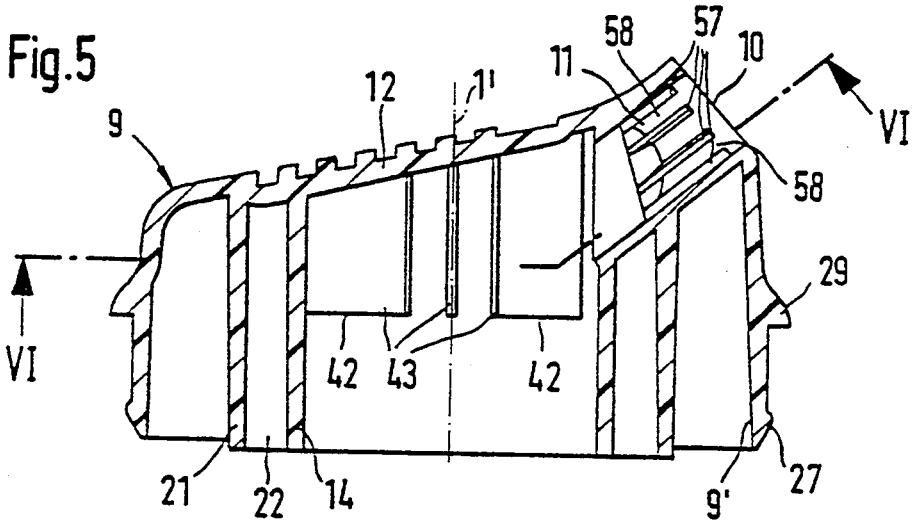
FIG. 5 is a sectional view of the housing upper part as an individual part.
Figure 6:
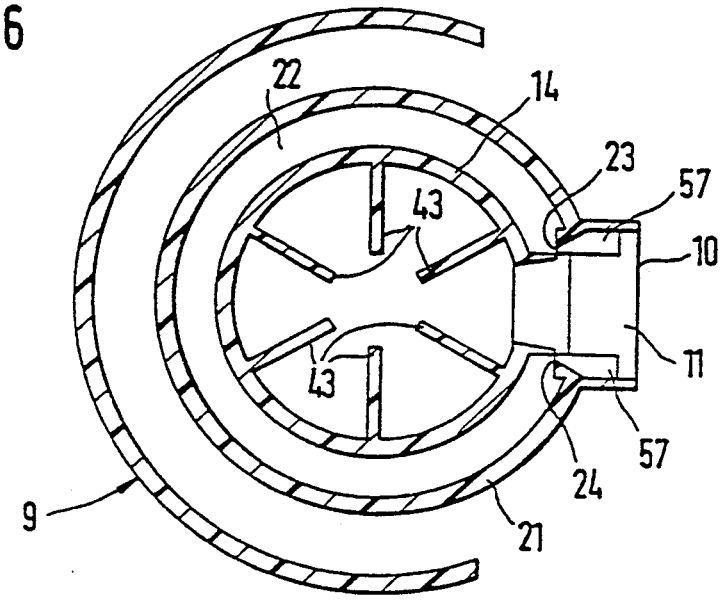
FIG. 6 is a sectional view taken along VI—VI from FIG. 5.
Figure 7:
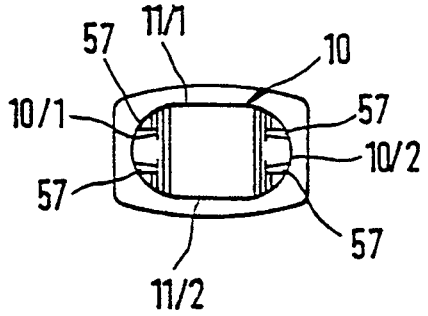
FIG. 7 is a front view VII of the discharge opening according to FIG. 5.

Above the cylindrical wall section 9' provided with a circumferential locking rib 27 and an annular shoulder 29 seated on the upper surface 28 of the outer wall 25, the housing upper part 9 shown as an individual component in FIGS. 5, 6, and 7 is provided with wall sections of different shapes, which are essentially aligned with the discharge opening 10 or the discharge channel 11 extending obliquely to the center line 1' at an angle of ca. 45°.

Above a the radial partition 13, the outer wall 25 of the housing lower part 8 is provided with an inner, circumferential locking groove 26, which is used to lockingly accommodate the locking rib 27 of the housing upper part 9.

A cylindrical annular wall socket 30, which sealingly and telescopingly accommodates a likewise cylindrical, upwardly directed annular wall socket 31, which in turn is made in one piece with the radial wall 19 of the lower housing part 3, is made in one piece with the underside of the partition 13 and concentrically to the bellows 4. The internal diameters of the two annular wall sockets 30 and 31 are selected to be such that they are located at a certain radially spaced location from the circumference of the bellows 4, thus forming a second, annular pump chamber 33 with the bellows 4. The first pump chamber 32 is formed by the hollow space of the bellows 4 in the known manner.

The second pump chamber 33 communicates with the annular channel 22 through a plurality of axially parallel flow openings 34 of the partition 13, which are arranged in a distributed pattern.

A conical valve seat annular surface 20, which is joined by a cylindrical pipe socket 35 directed in the downward direction, is located in the center of the partition 13. The pipe socket 35 is surrounded, at a certain, radially spaced location, by an annular wall 36, which is open at the bottom, and on which an upper annular front wall 37 of the bellows 4 is supported. In its center, the front wall 37 has a collar 38, which sealingly surrounds the pipe socket 35.

The discharge valve has a closing cone as an axially movable closing member 39, which is designed as a hollow body, is guided in the cylindrical pipe socket 35 by means of an axial cross rib 40, and is provided, at its upper end, with an axially elastic annular shoulder 41, which is in elastic contact with the flat lower edges 42 of a plurality of radial ribs 43 of the housing upper part 9, and which sealingly presses the lower delimiting edge 44 of the closing member 39 against the valve seat annular surface 20. The annular shoulder 41 has openings, not visible in the drawing, through which the medium is able to flow axially.

The lower end of the bellows 4 has an annular wall 45, which sealingly surrounds a cylindrical wall 46 of a concentric, pot-shaped mounting socket 47, which projects in the direction of discharge. The mounting socket 47 has, on the one hand, an annular front wall 48, with which a downwardly directed connection piece 49 is made in one piece. The connection piece 49 has a cylindrical inner surface 50 and a downwardly conically tapering, outer jacket surface 51. An axially movable closing member 52 of the suction valve 5, which lies on a likewise conical valve seat surface 54 with a conical closing disk 53, is seated in the connection piece 49. The closing member 52 is provided, on the underside of the closing disk 53, with a cross rib 55, by which it is guided at the cylindrical inner surface 50 of the connection piece 49. A total of three holding fingers 56, which prevent the closing member 52 from falling out, are arranged on the top side of the annular front wall 48 of the mounting socket 47.

A preferably cylindrical enveloping body or an enveloping body of elliptical cross section, which is used to completely accommodate a paste container 61 provided with a fitting cross-sectional shape, and which has a thickened, circumferential edge bead 62 at its lower end, is made in one piece with the housing part 3 under the radial wall 19. The relatively thin-walled paste container 61 is provided with a follower plunger 64 introduced into its open lower end 63, and it has, at its the lower end 63, an annular shoulder 68, which forms an annular groove 67 with the slightly conically expanding end section 65 of its enveloping wall 66, and is provided with an inwardly directed, upper peripheral edge 69. As a result, the thickened edge bead 62 of the enveloping body 60 can be lockingly introduced into the annular groove 67 when the paste container 61 is pushed into the enveloping body 60 from below. Due to the edge bead 62 and the annular shoulder 68, the lower ends of the enveloping body and of the paste container 61 each have increased dimensional stability, which facilitates handling to the extent that no particular care must be taken to avoid accidental deformations during the introduction and removal of the paste container 61 into and from the enveloping body 60.

Figure 3:
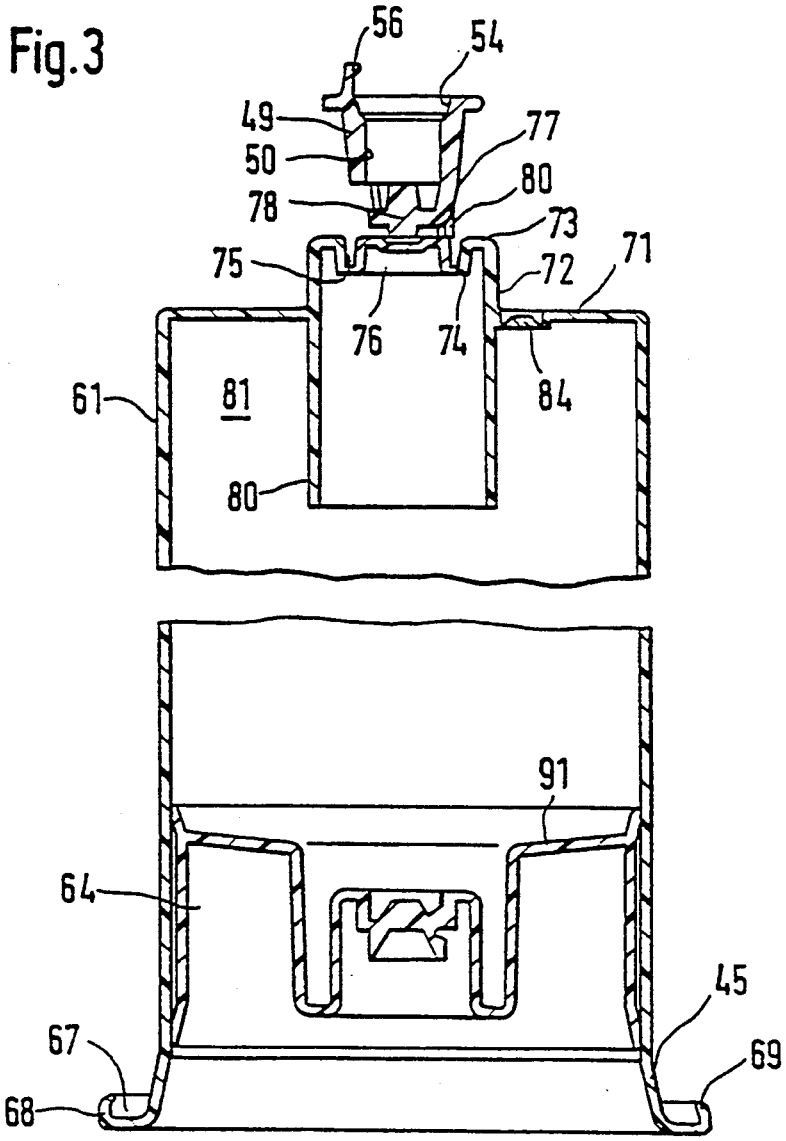
FIG. 3 is a sectional view of a cartridge-like paste dispenser.

At its top end, the paste container 61 (FIG. 3) has, at a front wall 71, a collar 72 projecting against the suction valve 5 of the dispensing pump 1. The collar 72 is provided with an inwardly directed sealing ring 74, which is made in one piece with a front wall ring 73, and on which a pot-shaped cutoff closure 76 is integrally cast via a thin, annular cutoff web 75 (FIG. 3).

To automatically separate the cutoff closure 76 from the sealing ring 74 when the paste container 61 is pushed completely into the enveloping body 60 of the dispensing pump 1 and to push it completely into the interior of the paste container 61, in order for a discharge opening to be formed for the paste contained in the paste container 61, an opening plunger 78, which separates the cutoff closure 76 from the sealing ring 74, is made in one piece with the lower front side of the connection piece 49 of the housing part 3 via a plurality of axial supports 77 arranged in a distributed pattern. The opening plunger 78 is provided with a plurality of pressing fingers 79, which separate the cutoff closure 76 from the sealing ring 74 during the introduction of the collar 72 of the paste container 61 into the mounting socket 47 of the housing part 3, and push it into the interior of the paste container 61, as is shown in FIGS. 1 and 1*a*.

A cylindrical suction socket 80 is made in one piece with the front wall 71 of the paste container 61 as a projection of the collar 72 directed downward into the interior of the container. The annular chamber 81 surrounding the suction socket 80 is provided to receive a second medium, which is to be pumped into the discharge channel 11 through the second pump chamber 32, the flow openings 34, and the annular channel 22. The radial wall 19 of the housing part 3 is provided for this purpose with one or more, preferably three, suction channels 82, which are arranged in the radial area located between the wall 46 and the annular wall socket 31, and open into the second pump chamber 32. The suction channels 82 are extended in the downward direction by sleeve-like projections 83, which are also used to pierce cutoff closures 84 of the front wall 71, which are arranged eccentrically outside the suction socket 80 in a correspondingly distributed pattern, and to establish the connection to the annular chamber 81 of the paste container.

To facilitate this piercing of the cutoff closures 84, the lower front edges of the projections 83 are sharp-edged, and to ensure that the cutoff closures 84 are folded to the side at the same time during separation, the lower front edges of the projections 83 are designed as obliquely extending projections.

Due to the opening plunger 78 being connected by the axial webs 77 to the connection piece 49, the paste located in the paste container 61 is able to flow nearly unhindered into the connection piece 49 and can be drawn through same into the interior of the bellows 4, while the housing part 2 is again moving in the upward direction after a downwardly directed stroke movement. At the same time, a substantially smaller amount of the second medium is drawn from the annular chamber 81 into the second pump chamber 33, which has a smaller volume.

An elastic, annular valve lip 85, which prevents the medium from flowing from the second pump chamber 33 back into the suction channels 82, but permits more of the second medium to flow into the second pump chamber 33 during the suction process, is preferably made in one piece with the circumference of the lower, cylindrical end section 35 of the bellows 4 to ensure valve-like closing of the suction channels 82 or to form a second suction valve 5' for the second pump chamber 33.

However, it is also possible to omit the valve lip 85. At any rate, this makes it necessary to make the overall flow cross section of the suction channels 82 smaller than the total flow cross section of the flow openings 34 of the partition 13 of the upper housing part 2, so that a sufficient dynamic pressure, which is able to bring about delivery of the second medium through the flow openings 34 and the annular channel 22 to the discharge channel 11, is generated in the second pump chamber 32 during the downwardly directed working stroke of the upper housing part 2.

Figure 4:
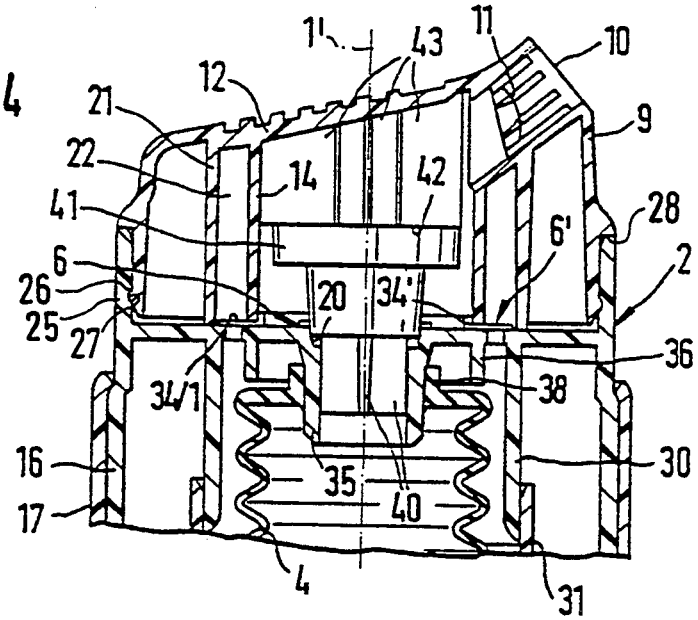
FIG. 4 is a sectional view of the upper part of another embodiment of the dispensing pump.

In the embodiment of the dispensing pump 1 shown in FIG. 4, the flow openings 34 of the partition 13 are covered on the top side by an elastic annular lip 34/1 in the manner of a directional valve; the annular lip 34/1 thus forms a second discharge valve 6'. The annular lip 34/1 is located under the annular channel wall 21 on the front side, and is centered thereon by means of an inner centering projection 34'.

To ensure that the smallest possible residual amount of paste remains in the paste container 61 when the follower plunger 64 has reached the top front at axial cross rib 40, the radial wall 91 of the follower plunger 64 is provided in its center with an annular depression 92, into which the suction socket 80 and the opening plunger 78 and possibly also the separated cutoff closure 76 can dip.

FIGS. 8 through 11 show another paste dispenser, in which an enveloping body 60/1, which simultaneously replaceably accommodates—directly next to each other in the parallel position—two cylindrical, cartridge-like paste containers 61/1 and 61/2, which are provided with follower plungers 101, is made in one piece at an elongated oval partition 100 of a lower housing part 3/1. According to the cross-sectional shape shown in FIG. 9, the enveloping body 60/1 has two semicircular wall sections 107, 108, which are arranged symmetrically in relation to an axis of symmetry 106, and which are connected to one another by straight wall sections 109, 110 that are parallel to each other.

The two paste containers 61/1, 61/2 may, but do not have to, have the same shape. Their the upper front walls 102, 103 are provided with the cylindrical connection openings 104, 105 each, which are arranged near the edge, i.e., eccentrically, and which are closed in the original state by closing covers that can, e.g., be broken off or be pushed into the interior of the container. The lower housing part 3/1 of a dispensing pump 1/1 is made in one piece with the top side of the partition 100, eccentrically offset in relation to the axis of symmetry 106, and the dispensing pump 1/1 is, in principle, of the same design as the dispensing pump 1 of the above-described embodiment. The differences between these the two dispensing pumps 1 and 1/1 will be described in greater detail below.

The upper housing part 2/1 differs from the housing part 2 only in that the annular wall socket 30/1 forming the second pump chamber 33/1 has a larger diameter in order for the second pump chamber 33/1 to have the same pump volume as the first pump chamber 32. The lower annular wall socket 31/1, which telescopingly and sealingly extends into the upper annular wall socket 30/1 and is made in one piece with the top side of the partition 100, also has a correspondingly larger diameter.

It is also possible to make two paste containers directly in one piece with the partition 100 instead of the enveloping body 60/1 accommodating the two separate paste containers 61/1, 61/2.

It would also be possible to replace the enveloping body 60 (FIG. 1) with a paste container made in one piece with the radial wall 19.

The upper cylindrical end section 38/1 of the bellows 4/1 surrounds an annular wall 36/1, which concentrically surrounds the pipe socket 35 at a radially spaced location. An upwardly bent, elastic annular lip 112, which forms the movable closing member of a second discharge valve 111, and is in sealing contact with the inner surface of the annular wall socket 30/1 in the direction of backflow, is made in one piece with the jacket surface of the end section 38/1.

The lower, cylindrical end section 45/1 of the bellows 4/1 is sealingly seated in an upwardly directed annular shoulder 47/1, which forms an annular channel 113, which is open at its top, with the annular wall socket 31/1 of the partition 100. An upwardly directed annular projection 114, which is open at the top and acts as a valve seat surface, is located within and concentrically to the annular shoulder 47/1, and a cap-like valve closing member 115, which is made in one piece with the lower end section 45/1 of the bellows 4/1, is elastically and sealingly seated on the annular projection 114, and the valve closing member 115 forms, together with the annular projection 114, the first suction valve 116 of the dispensing pump 1/1, which is located within the bellows.

The cylindrical hollow space 117 of the annular projection 114 communicates with the likewise cylindrical outlet channel 118/1 of a first, eccentric suction socket 118, which extends into a connection opening 105 of the right-hand 61/2, and which has separated the closing cover (which may have been present) of the connection opening 105 during the insertion of the paste container 61/2 into the enveloping body 60/1. The annular channel 113 analogously also communicates with a second suction channel 117/1 of a second suction socket 119, which is arranged symmetrically to the suction socket 118 in relation to the plane of symmetry 106, and which extends into the connection opening 104 of the other paste container 61/1. An elastic annular lip, which is made in one piece with the circumference of the lower end section 45/1 of the bellows 4/1, is in sealing contact all around the inner side of the annular wall socket 31/1, covers the annular channel 113, and blocks same in the direction of backflow, acts as a second suction valve 120 associated with the second pump chamber 33/1.

Figure 8:
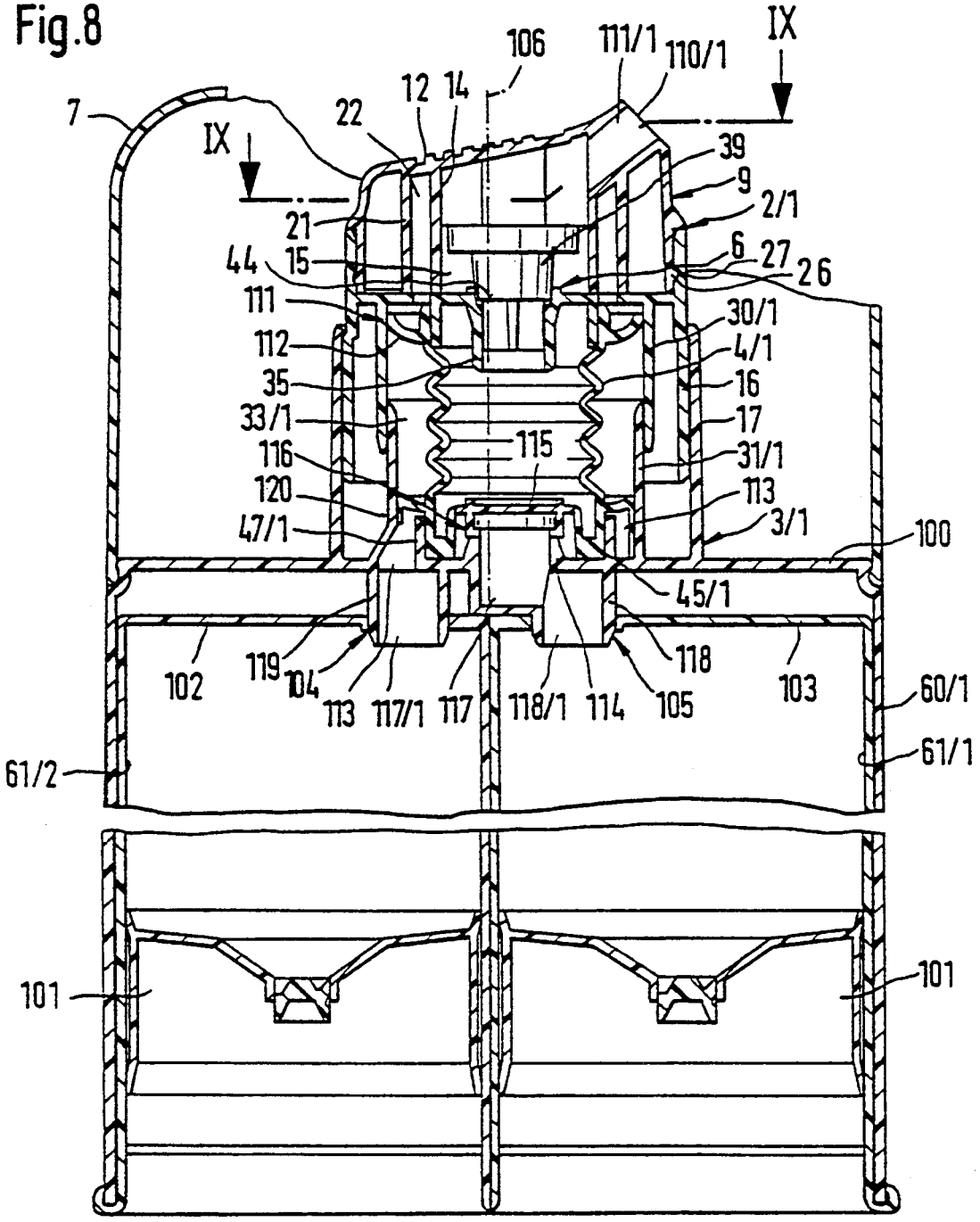
FIG. 8 is a sectional view of a paste dispenser with the dispensing pump according to the present invention and with two cartridge-like paste containers of equal size, each of which is provided with a follower plunger.
Figure 9:
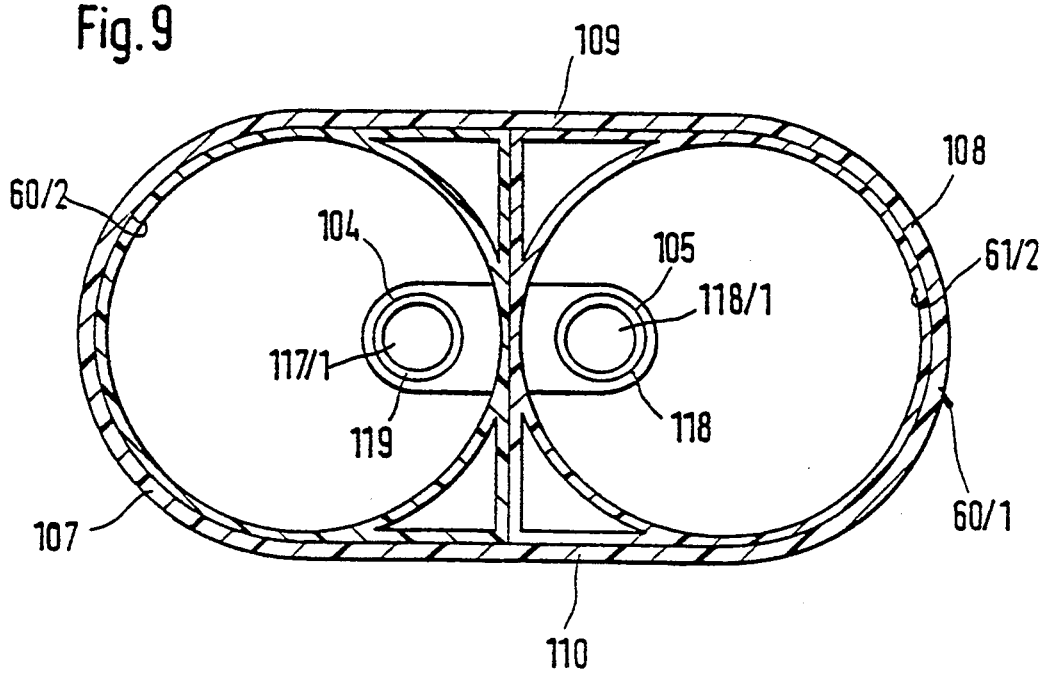
FIG. 9 is a sectional view taken along line IX—IX from FIG. 8.
Figure 10:
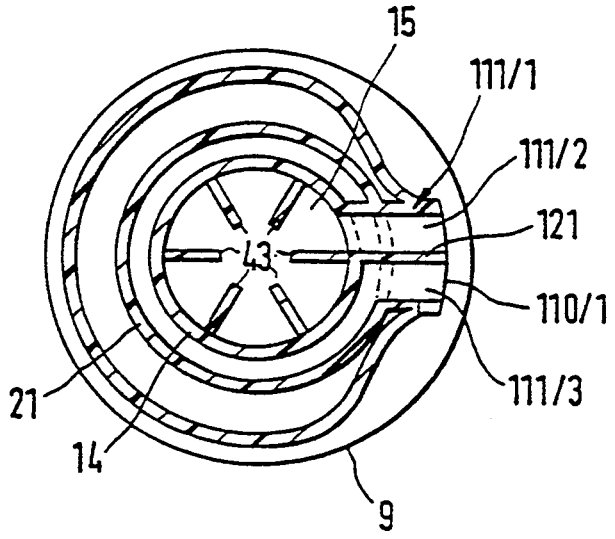
FIG. 10 is a sectional view taken along line X—X from FIG. 8.
Figure 11:
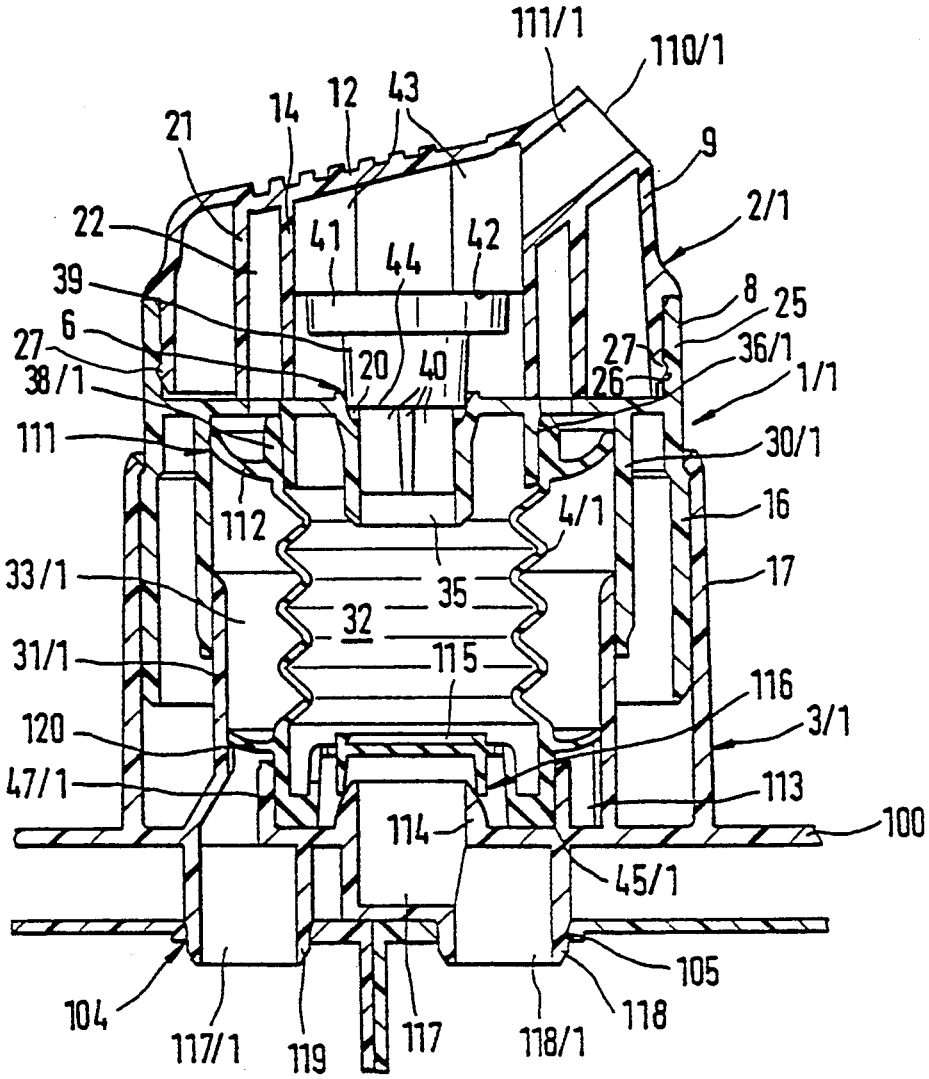
FIG. 11 is a sectional view of the dispensing pump according to FIG. 8 on an enlarged scale.

As is apparent from the sectional representation in FIG. 10, the discharge channel 111/1 and the discharge opening 110/1 in the embodiment according to FIGS. 8 through 10 are provided with a partition 21, which extends in parallel to the axis of symmetry 106, i.e., vertically, and which divides the discharge channel 111/1 and the discharge opening 110/1 into two compartments 111/2 and 111/3 of equal cross section. It is also possible here to have the partition 12 1 end within the discharge opening 110/1, so that only the discharge channel 110/1 is divided and/or arranged such that compartments 111/2 and 111/3 of different cross sections will be obtained.

It can easily be imagined that the two paste dispensers described operate, in principle, in the same manner: Part of the media contained in the two pump chambers 31, 33 and 33/1 is delivered to the outside through the suction channel 11 and the compartments 111/2, 111/3 of the divided discharge channel 111/1 during each downwardly directed working stroke of the upper housing part 2 or 2/1, i.e., during each working stroke directed toward the radial wall 13 or the partition 100. During the subsequent suction stroke, which is brought about by the restoring force of the bellows 4 or 4/1, during which the upper housing part 2 or 2/1 returns into its upper starting position, the two media contained in the paste containers are drawn from the annular chamber 81 and the rest of the hollow space of the annular shoulder 41 or from the two paste containers 61/1 and 61/2 into the pump chambers 32, 33 or 33/1, in the same way as they were discharged before during the working stroke. The amounts pumped through the two pump chambers 32, 33 or 32, 33/1 are adjusted to the quantity ratios at which the two media are actually available.

The existing quantity ratio of one medium to the other is about 1:10 in the paste container 61; the ratio of the amounts pumped by the two pump chambers 32 and 33 also corresponds to that ratio. In contrast, the quantity ratio of medium A to medium B equals 1:1 in the case of the two paste containers 61/1 and 61/2 of equal size, so that the volumes pumped through the two pump chambers 32 and 33/1 are also equal.

The particular advantage of the dispensing pumps 1 and 1/1 according to the present invention is mainly the fact that no additional individual parts are needed to form the second pump chamber, but the means used consist of shaped elements, and the components already present are made in one piece, and the circumstance that assembly is not made any more expensive by the added shaped elements at all can be considered to be another important advantage.

While specific embodiments of the invention have been shown and described in detail to illustrate the application of the principles of the invention, it will be understood that the invention may be embodied otherwise without departing from such principles.

What is claimed is:

1. A dispensing pump formed of plastic for dispensing metered amounts of media of low viscosity from a container, the dispenser comprising:

a dimensionally stable upper housing part;

a dimensionally stable lower housing part, said upper housing part and said lower housing part being positioned telescopingly movable relative to each other;

an elastic bellows defining a pumping member, said elastic bellows being connectingly arranged between said upper housing part and said lower housing part and being coaxial thereto whereby an interior of said elastic bellows forms a pump chamber through which a medium is pumped, said upper housing part having a radial partition provided with a paste flow opening, said elastic bellows being in sealing contact with an annular wall of said radial partition, said lower housing part having a lower housing part radial partition and said elastic bellows being in sealing contact with an annular shoulder of said lower housing part radial partition, said upper housing part having a discharge opening and said lower housing part having a suction valve connecting the paste container to the pump chamber and including a suction tube socket connected to said container;

an upper annular wall socket formed in one piece with said upper housing part;

a lower annular wall socket formed in one piece with said lower housing part, said upper annular wall socket and said lower annular wall socket being telescopingly guided one inside the other and surrounding said bellows at a radially spaced location to define a second pump chamber, said second pump chamber communication with said discharge opening through said flow opening of said upper housing part radial partition, said second pump chamber being connected to at least one eccentric suction channel of said radial partition of said lower housing part.

2. A dispensing pump in accordance with claim 1, wherein said flow opening of said radial partition of said upper housing part opens into an annular channel of the upper housing part, which communicates with said discharge opening.

3. A dispensing pump in accordance with claim 2, wherein said flow opening of said radial partition of said upper housing part is closed from a direction of said annular channel by elastically seated closing members, to form a discharge valve.

4. A dispensing pump in accordance with claim 1 wherein said upper end section of said bellows has radial annular lips, which are in elastic sealing contact with an inner side of a corresponding one of said annular wall sockets and can be lifted off alternatingly from an inner side thereof by flow forces of a second medium.

5. A dispensing pump in accordance with claim 1 wherein said flow openings of said radial partition of said upper housing part are arranged outside a radial area of a chamber wall connected to said upper end section of the bellows (4, 4/1).

6. A dispensing pump in accordance with claim 2 wherein said annular channel opens into a discharge channel of said discharge opening through openings on two diametrically opposite sides.

7. A dispensing pump in accordance claim 1 wherein said radial partition of said lower housing part (3/1) is provided with two downwardly directed suction sockets, whose separate hollow spaces each communicate with one of said first two pump chamber and said second pump chamber.

8. A dispensing pump in accordance with claim 7 wherein said two suction sockets are arranged diametrically and symmetrically opposite in relation to an axis of symmetry, and extend into separate containers.

9. A dispensing pump in accordance with claim 8 wherein said two separate containers are each provided with a follower plunger.

10. A dispensing pump in accordance with claim 1 wherein said second pump chamber has at least approximately the same pump volume as the first pump chamber.

11. A dispensing pump in accordance with claim 2, wherein said discharge opening of said upper housing part is subdivided by a partition into two compartments, of which a first compartment communicates with the annular channel, and a second compartment communicates with a discharge chamber of the first pump chamber or with the flow opening thereof.

12. A dispensing pump in accordance with claim 1 wherein said discharge opening has the outer opening end of a discharge channel, whose inner surface is provided, at least in some areas, with striping channels, which are formed by guide ribs.

13. A dispenser pump according to claim 1, wherein said eccentric suction channel is connected to said container.

14. A dispensing pump according to claim 1, further comprising a second container, said eccentric suction channel being connected to said second container.

15. A dispensing pump according to claim 1, wherein said lower end section of said bellows has radial annular lips, which are in elastic sealing contact with an inner side of a corresponding one of said annular wall sockets and can be lifted off alternatingly from an inner side thereof by flow forces of a second medium.

16. A dispensing pump according to claim 2, wherein said discharge channel of said upper housing part is subdivided by a partition into two compartments including a first compartment communicating with the annular channel, and a second compartment communicating with a flow opening of the first pump chamber.

* * * * *